US007778005B2

(12) United States Patent
Saliga

(10) Patent No.: US 7,778,005 B2
(45) Date of Patent: Aug. 17, 2010

(54) ELECTRIC DISABLING DEVICE WITH CONTROLLED IMMOBILIZING PULSE WIDTHS

(76) Inventor: Thomas V Saliga, Electronic Design Associates, 12918 Commodity Pl., Tampa, FL (US) 33636

( * ) Notice: Subject to any disclaimer, the term of this patent is extended or adjusted under 35 U.S.C. 154(b) by 232 days.

(21) Appl. No.: 11/746,952

(22) Filed: May 10, 2007

(65) Prior Publication Data

US 2008/0278882 A1 Nov. 13, 2008

(51) Int. Cl.
*F41B 15/04* (2006.01)

(52) U.S. Cl. ..... 361/232

(58) Field of Classification Search ..... 361/232, 361/230; 102/501, 502; 42/1.08
See application file for complete search history.

(56) References Cited

U.S. PATENT DOCUMENTS 5,654,867 A 8/1997 Murray
5,960,207 A * 9/1999 Brown ..... 713/300
6,636,412 B2 10/2003 Smith
6,999,295 B2 * 2/2006 Watkins et al. ..... 361/232
7,102,870 B2 * 9/2006 Nerheim ..... 361/232
7,110,897 B2 * 9/2006 Nadig et al. ..... 702/66
7,145,762 B2 12/2006 Nerheim
7,218,501 B2 * 5/2007 Keely ..... 361/232
7,237,352 B2 * 7/2007 Keely et al. ..... 42/1.08
2006/0256498 A1 * 11/2006 Smith et al. ..... 361/232
2006/0292528 A1 * 12/2006 Keely et al. ..... 434/11
2007/0081292 A1 * 4/2007 Brundula et al. ..... 361/232
2007/0097592 A1 * 5/2007 Smith ..... 361/232
2008/0130192 A1 * 6/2008 Nerheim ..... 361/232

* cited by examiner

*Primary Examiner*—Jared J Fureman
*Assistant Examiner*—Angela Brooks
(74) *Attorney, Agent, or Firm*—David Kiewit

(57) ABSTRACT

A capacitive discharge stun-gun uses a flyback output circuit in which a semiconductor switch operates under control of a controller or suitable logic circuitry. The flyback circuit can deliver 50-65 kV pulses to a pair of electrodes in order to ionize air adjacent a target in order to initiate good electrical contact. When the electrodes are in good contact with the target, the flyback circuit delivers current at a lower voltage. In one mode of operation the stun-gun is controlled to initially deliver wider pulses optimized for causing air breakdown and to then deliver a series of shorter pulses in pulse groups optimized for causing involuntary muscle cramping.

5 Claims, 4 Drawing Sheets

ELECTRIC DISABLING DEVICE WITH CONTROLLED IMMOBILIZING PULSE WIDTHS

BACKGROUND OF THE INVENTION

1. Field of the Invention

The invention generally relates to electric systems and devices that generate and accumulate charge for application to living beings. More specifically, the invention relates to electric disabling devices commonly referred to as stun-guns, stun-batons or the like for delivering an incapacitating, but less than lethal, sequence of electric shocks to a person.

2. Background Information

Hand-held stun-guns are widely used by police officers to subdue uncooperative or potentially dangerous individuals by subjecting them to electric current pulses inducing incapacitating muscle cramps. The jolt from a stun gun is intended to cause such severe cramping as to prohibit locomotion and to cause the victim to fall to the ground. Generally speaking, there are two limiting concerns in delivering an incapacitating electric shock. At one extreme, if too little energy is delivered to a targeted individual, he or she may not be incapacitated and may be able to persist in an attack on a police office. On the other hand, if extremely large electrical currents are delivered, the shock may be lethal, rather than merely incapacitating.

Prior art stun guns operate by charging a capacitor to a relatively high voltage and then discharging the capacitor through the primary winding of a step-up transformer so as to produce a much higher voltage on electrodes propelled toward a target. If the electrodes are not in intimate contact with the target, voltages on the order of 50-60 kV need to be supplied to the electrodes to ionize the air between the electrodes and the target to establish a current path. Once contact has been established lower voltages, on the order of hundreds to a few thousand volts, are adequate for sending disabling current pulses through the target.

In a typical prior art stun gun the capacitive discharge is controlled by a gas discharge tube. The capacitor is charged from a relatively high voltage power supply until the voltage across its terminals is high enough to trigger breakdown in the gas discharge tube, and to cause the gas discharge tube to switch from its initial non-conducting state to a highly conductive state in which the capacitor is electrically connected to the transformer. The capacitor then discharges through the primary winding of the transformer until its voltage falls below the minimum voltage at which the gas discharge tube will conduct. The gas discharge tube then switches to its original high resistance state and the cycle can be repeated. In this arrangement the pulse duration, repetition rate, output voltage, etc. are determined by component selection. That is, one can select gas discharge tubes with different turn-on and turn-off voltages, but once the turn-on voltage is attained, the device will conduct until the voltage falls below the turn-off level.

Physiological studies of the effects of electrical impulses on nerves that control skeletal muscles indicate that a pulse needs to last longer than about 150 microseconds to be efficient at 'firing' the nerve tissue, which is critical for causing cramping or immobilization. Once stimulated, the nerve tissue requires four milliseconds or more to recover.

BRIEF SUMMARY OF THE INVENTION

It is an object of the invention to tailor the energy delivery sequence of a stun device, such as a stun gun, to more thoroughly incapacitate nerve tissue while delivering less total energy than is the case with prior art stun devices. In preferred embodiments this is provided by applying incapacitating pulses lasting between 150 and 300 microseconds. Further, because nerve tissue has a recovery period (depolarization and refractory period) of approximately 4 milliseconds, preferred embodiments of the invention deliver a plurality of energy pulse groups having an interval of about 4 milliseconds between pulse groups.

A preferred embodiment of the invention provides an electric disabling device configured as a handgun for immobilizing a human or animal target. This gun, similar to other such devices, comprises at least two projectile electrodes for positioning at spaced apart contact points adjacent a target and a suitable propelling means, such as pressurized gas or a pyrotechnic charge, for propelling the projectile electrodes from the device towards the target. The preferred device also comprises a transformer having primary and secondary windings, a capacitor, and a DC power supply operable to charge the capacitor element. Each end of the secondary winding of the transformer is electrically connected to only one of the two electrodes. The preferred embodiment also comprises a semiconductor switching device controllable by a control circuit to repeatedly switch between a conducting and a non-conducting state so as to cause pulses of current to flow from the capacitor through the primary winding of the transformer. In particular preferred embodiments, the semiconductor switching element is an insulated gate bipolar transistor (IGBT).

In an initial preferred contact-establishing method of operating such an electric disabling device the capacitor is initially charged from the DC power supply to a predetermined maximum voltage and the semiconductor switching device is controlled by the controller to close for a discharge interval having a selected duration of more than 15 but less than 50 microseconds. This assumes that a step up transformer with a primary inductance of about 50 micro-henries is utilized. At the end of the selected discharge interval the switching element is opened and held open for a pause interval having a selected duration at least as long as the discharge interval and at most five times as long as the discharge interval. The discharge and pause steps are then repeated at least once and preferably between five and ten times until the capacitor is substantially fully discharged.

In a second preferred immobilizing method of operating such an electric disabling device, the capacitor is charged from the DC power supply and the semiconductor switching device is controlled by the controller to close for a discharge interval having a duration of more than 5 but less than 20 microseconds. At the end of the discharge interval the switching element is opened and held open for a pause interval having a selected duration at least as long as the discharge interval and at most five times as long as the discharge interval. The number of such switching actions is adjusted to discharge the capacitor to approximately 40% of its maximum rated energy storage value and span a duration of approximately 200 microseconds. Then, during an idle period of substantially 4 millisec the capacitor is partially recharged to 50% or more of its rated capacity and then the above process is repeated until the capacitor is substantially fully discharged. Thereafter, the capacitor is fully recharged and the process is repeated after a recharge delay between 50 and 100 milliseconds.

A particular preferred method of operating a disabling device of the invention comprises carrying out the first and second methods in sequence. That is, the controller controls the switching element to initially deliver high voltage pulses optimized to both fire the pyrotechnic charge and establish contact and to then deliver immobilizing pulses. If the projectile electrodes are not initially in intimate contact with the target, as is usually the case, the secondary of the transformer is essentially open-circuited so that pulsing the primary causes 'flyback' voltages in the secondary that can reach fifty to seventy kilovolts, which is known to be high enough to ionize the air between each projectile electrode and the target and to lead to intimate electrical contact. Once contact has been established to the target, the secondary of the transformer is no longer open-circuited and pulsing the primary results in lower voltage, higher current pulses in the secondary that can be controlled to have an optimal immobilizing duty cycle. In particular preferred embodiments, a 100 V DC power supply charges the capacitor, which is discharged through a 55:1 step-up transformer that outputs about a 2 kV pulse to the target, which is generally viewed as about a 1 kΩ load once contact has been established.

Although it is believed that the foregoing rather broad summary description may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed in the following Detailed Description as a basis for designing other arrangements for carrying out the same purposes of the present invention and that such equivalent constructions are within the spirit and scope of the invention in its broadest form. Moreover, it may be noted that different embodiments of the invention may provide various combinations of the recited features and advantages of the invention, and that less than all of the recited features and advantages may be provided by some embodiments.

DETAILED DESCRIPTION OF A PREFERRED EMBODIMENT OF THE INVENTION

In studying this Detailed Description, the reader may be aided by noting definitions of certain words and phrases used throughout this patent document. Wherever those definitions are provided, those of ordinary skill in the art should understand that in many, if not most instances, such definitions apply to both preceding and following uses of such defined words and phrases. At the outset of this Description, one may note that the terms "include" and "comprise," as well as derivatives thereof, mean inclusion without limitation; the term "or," is inclusive, meaning and/or. Moreover, inasmuch as the preferred embodiment described herein involves controlled capacitive storage of electrical charge and subsequent discharge of it, it should be noted that the term 'capacitor' is sometimes used herein to denote either or both of a single physical component and various combinations of such components that can be viewed as being equivalent to a single capacitive component. In particular, a plurality of single capacitive components electrically connected in parallel so as to provide a total capacitance equal to the sum of the capacitances of the individual components will sometimes be herein referred to as a 'capacitor'.

Figure 1:
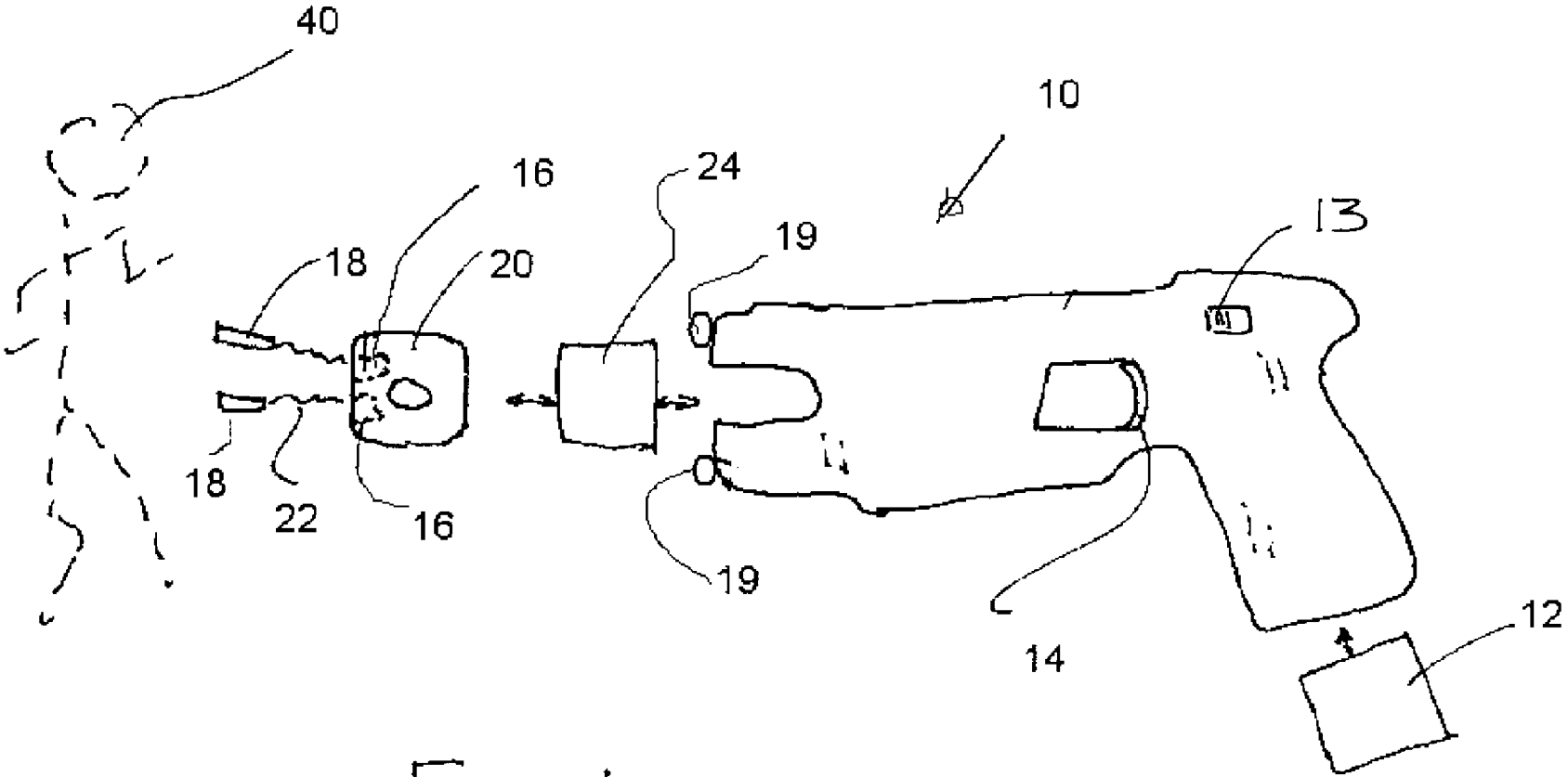
FIG. 1 is a largely schematic exploded block diagram of an electrical incapacitating device of the invention.

Turning now to FIG. 1, one finds a schematic exploded view of a disabling device or stun-gun 10. As is conventional in the art, the stun device is powered by a removable and replaceable battery pack 12. In a particular preferred embodiment the battery pack comprises a plurality of lithium primary batteries such as the 123 size or the CR2 size inserted into the handle or butt of the stun-gun. After a safety-switch 13 is enabled to apply battery power, pulling the trigger 14 ignites a pyrotechnic charge 16 that fires dart-like projectile electrodes 18 from a replaceable cartridge 20. The projectile electrodes trail fine wires 22 behind them to keep them electrically connected to a power electronics portion 24 of the stun-gun. It may be noted that although the power electronics portion 24 of the gun 10 is depicted as a square block, this is an entirely schematic depiction selected for clarity of presentation. In reality, various elements of the power electronics portion of the weapon are tucked away in available nooks and crannies of the body of the weapon.

Moreover, although the initially preferred embodiment of the invention comprises a stun gun having both projectile 18 and fixed 19 electrodes, the reader will appreciate that the same inventive circuitry and operating methods can be employed for making other electrically incapacitating devices using only fixed electrodes 19 incorporated into batons, battle-shields, or restraint bracelets and belts, and that all such other uses shall be considered to be within the spirit and scope of the invention.

Figure 2:
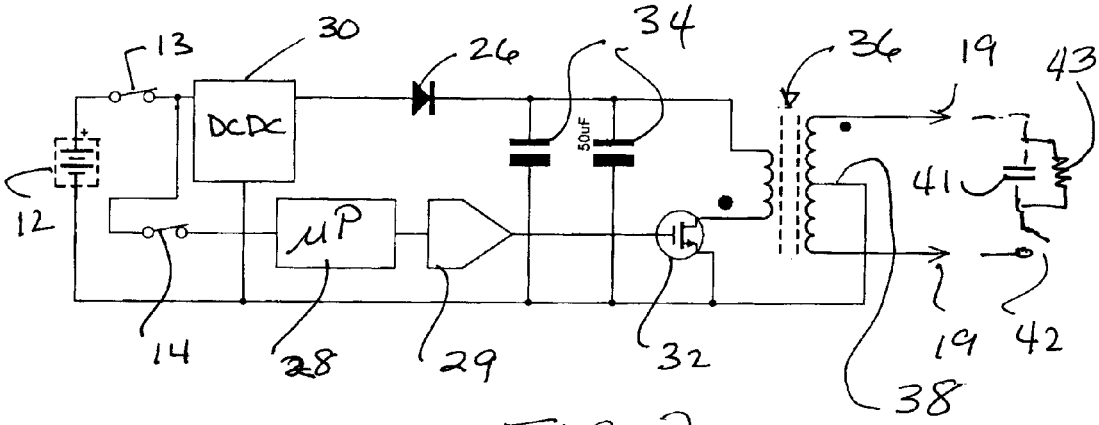
FIG. 2 is a schematic block diagram of a circuit for an electrical incapacitating device of the invention, wherein depiction of some of the power wiring has been omitted in the interest of clarity of presentation.
Figure 4:
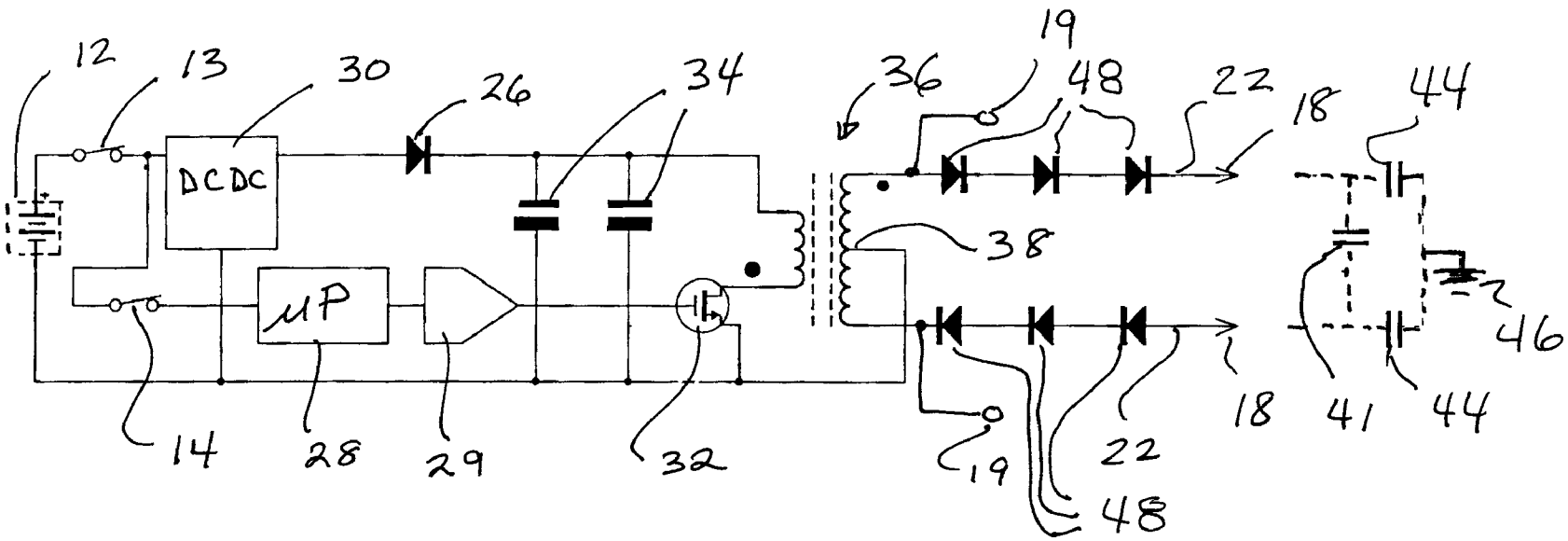
FIG. 4 is a schematic block diagram of a preferred circuit for a stun gun of the invention that can operate in the presence of substantial parasitic load capacitance.

The power electronics portion 24 of the stun-gun is schematically depicted in FIG. 2, for an electrically incapacitating device comprising only fixed electrodes, and in FIG. 4 for a preferred stun gun. In both cases the battery pack 12 powers a controller 28 and a high voltage DC-DC supply 30. When the device is triggered, the controller 28 controls the DC supply 30 and a controllable semiconductor switch 32 to charge a capacitor or capacitor bank 34 and to send current pulses through the primary winding of a step-up transformer 36, as will be described in greater detail hereinafter.

In a particular preferred embodiment, the power electronics portion of the stun gun is controlled by a microcontroller such as a Model 16F687 made by the Microchip Corporation. Those skilled in the control arts will recognize that although this arrangement is preferred, there are many other approaches that can be used to provide the necessary control features. These include, but are not limited to the use of other controllers as well as of hard-wired or custom programmed logic elements well known in the art.

The high voltage DC supply 30 is preferably any of many well-known step up, switching-type DC-DC power supplies circuits with a delivered power rating in the 10 watt to 20 watt range. When active, the preferred high voltage DC supply provides an output voltage of approximately 100 VDC.

Current from the high voltage DC supply 30 passes through a diode 26 to charge a capacitor 34. Although one can consider using a single capacitor component for this function, a preferred embodiment of the invention uses a parallel pair of capacitors, each having a capacitance of fifty microfarads to achieve a total capacitance in the 90 μF to 108 μF range. The use of a plurality of paralleled components offers the advantages of reducing the maximum current that has to be delivered by any one of them, and of allowing the designer to more efficiently use the space available within the body of the weapon by packing smaller individual capacitors into spaces available within a body of a stun gun 10 or other incapacitating device.

A semiconductor switch 32, which is preferably an insulated gate bipolar transistor (IGBT) Model IRG4PH50KDP supplied by the International Rectifier company, is controlled through a driver 29 by the controller 28 to discharge the capacitor 34 through the primary winding of the transformer 36. Although this element is depicted in FIG. 2 as being physically connected between the transformer and negative rail, those skilled in the art will recognize that the semiconductor switch 32 can be located at other positions in the circuitry.

The preferred IGBT 32 can be controlled to generate pulses of a controllable width that can be as narrow as one microsecond. It can also be used to generate a long string of such pulses during the course of a single discharge of the capacitor 34. It is noteworthy that this is a significant advantage over prior art stun-guns that employ a gas discharge tube to send a current pulse from a capacitor through the primary winding of a transformer. The prior art gas discharge tube operates in an 'all-or-nothing' mode and, once turned on, continues to conduct until the voltage on the capacitor falls below a predetermined voltage.

The preferred 55:1 ferrite core step-up transformer 36 is typically custom designed using well-known high-voltage transformer methods. In the preferred design, the primary inductance is 50 μH. It may be noted that the use of a controlled string of narrow pulses, when compared to the prior art approach of fully discharging the capacitor at each actuation, allows one to select a transformer with a smaller core size because core saturation is less of an issue. This use of a smaller transformer provides an additional benefit of reducing the overall size of the housing needed to contain it.

The transformer 36 may be designed to have either an ohmically floating secondary winding or may be center-tapped and have that center-tap 38 connected to the controller circuit's common rail. A practical advantage of the latter is that the voltage breakdown stresses may be reduced by a factor of two between the secondary wires 18 and primary common circuits. This significantly reduces insulation thickness requirements, permitting more compact design structures for the electronics output circuit module 24.

The circuit schematically depicted in FIG. 2 and FIG. 4 may be recognized as a flyback circuit that, when operated in pulsed mode, provides two drastically different sorts of outputs depending on the impedance across the output electrodes 18, 19. In one limiting case, one can consider the output electrodes 18 as being separated by a high impedance, such as an air gap. In the other limiting case, a relatively low resistance, provided by tissue of a target 40, is connected between the two output electrodes.

This accords well with the operational requirements of electrical incapacitating devices, such as a prisoner stun belt, baton, or other such devices. In an early stage of operation the output electrodes 18,19 are often not in intimate physical contact with a target and the output of the transformer is essentially open circuited. For example, a human target's clothing may space either or both of the electrodes away from his or her body by several centimeters. A high voltage output is required to ionize the air between the target's body and the electrode in order to establish effective electrical contact. Once an ionic air plasma or direct contact is established, a lower voltage can be used to send reasonable currents through the target, which now appears as a resistive load 43 of approximately 1 kΩ. This situation is schematically depicted in FIG. 2 where the target 40 is depicted as comprising an initial gap, depicted as a target capacitance 41 that is commonly on the order of ten picofarads, a switch 42, and a 1 kΩ resistor 43 connected across the transformer output once air ionization has acted to render the gap conducting.

If the output of the step-up transformer is open-circuited and the controllable IGBT switch 32 is suddenly closed, current flows from the high voltage DC power supply 30 and the substantial substantially charged capacitor 34. This current creates a magnetic field in the transformer inductance. If the controllable switch 32 is then abruptly opened, the magnetic field collapses and induces a large 'flyback' voltage spike, as is well known from Faraday's EMF Law, across the pairs of electrodes. In a particular preferred embodiment, using the circuit components described above, flyback voltage spikes of 55-65 kV were produced.

Figure 3A:
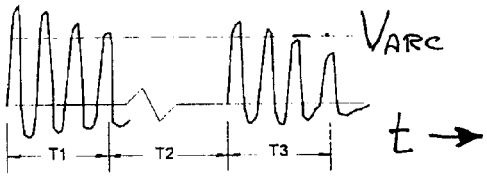
FIG. 3*a* is a schematic depiction of a train of pulses of output voltage of the circuit of FIG. 2 when an initial air gap is present between at least one electrode and a target.
Figure 5A:
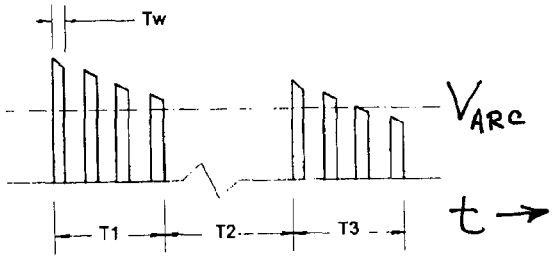
FIG. 5*a* is a schematic depiction of a train of pulses of output voltage of the circuit of FIG. 4 when an initial air gap is present between at least one electrode and a target, but when no substantial parasitic load capacitance is present.

In preferred embodiments, recognizing that it is likely that the output electrodes do not initially have good electrical contact with the target, the controller is programmed to open and close the switch in succession to generate a string of high voltage pulses as depicted in FIG. 3*a* and FIG. 5*a*. For the component values described above, each pulse had a peak value of 55-65 kV, as indicated by the $V_{ARC}$ line in those figures. A plurality of such pulses is created by repeatedly closing the controllable switch 32 for ten microseconds and then opening it for twenty to forty microseconds. The use of a string of high voltage pulses, rather than a single pulse, provides a higher probability that at least one of the pulses will result in air breakdown near the target with resulting good contact to the target. In a particular preferred embodiment, this "Max-Spark" high-spark energy waveform is generated for 0.1 to 0.25 seconds.

A further complication arises in the case of stun guns having projectile electrodes with trailing wires 22. In this case, a parasitic load capacitance 44 between either of the wires and earth ground 46 can absorb enough of the high voltage output pulses to prevent an arcing voltage from developing at the electrodes 18. This can occur, for example, when one or both of the trailing wires lies on damp ground or pavement.

Figure 5B:
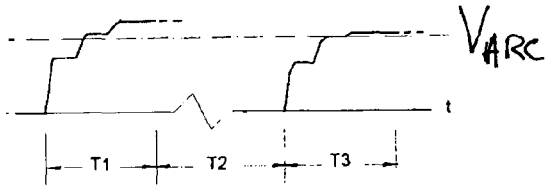
FIG. 5*b* is a schematic depiction of output voltage of the circuit of FIG. 4 when both an initial air gap and a substantial parasitic load capacitance are present.

In order to ensure that an arcing voltage is obtained in a stun gun application one can provide additional high voltage diodes 48 in the output circuit. In a particular preferred embodiment, depicted in FIG. 4, three VMI Type X100FG miniature, fast recovery, 10kV diodes are connected in each leg of the output circuit. This arrangement permits successive output pulses to repeatedly charge the load capacitance 44, 46 until the designed 55 kV arc-over voltage is attained, as schematically depicted in FIG. 5*b*. Those skilled in the art will appreciate that more or fewer diodes may be used in each arm leg of the output circuit, depending on the availability of suitable components. In any such arrangement, of course, it is preferable to select the diodes so that the series string of diodes provides a breakdown voltage (e.g., 60 kV in the depicted case) that is greater than the targeted arc-over voltage (e.g., 55 kV).

Figure 3B:
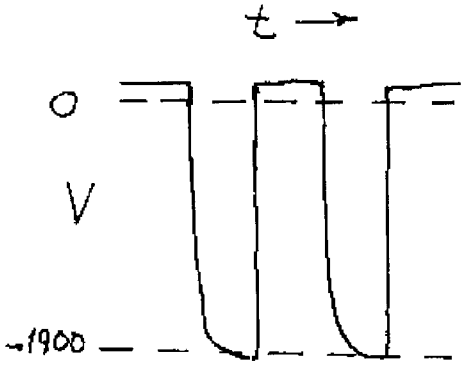
FIG. 3*b* is a schematic depiction of a several pulses of output voltage as a function of time when both electrodes have contacted a target.

The flyback circuits of FIG. 2 and FIG. 4 behave considerably differently if a relative low impedance, such as the 1000 ohms or so offered by a typical target 40, is connected across the electrodes 18,19. In this case, closing the controllable switch 32 causes the full voltage of the capacitor bank 34 to be applied across the transformer's primary 36 which in turn causes a substantially higher voltage to be applied across the secondary, as determined by its turns-ratio. This voltage is then applied across the target resistance. In a particular preferred embodiment the combination of a 100 V DC supply and a 55:1 step-up transformer generates a potential across the projectile electrodes of about 2 kV, where the balance of the nominal 5.5 kV is lost to parasitic resistance of the windings and electrode leads. A pulse of this sort is depicted in FIG. 3*b*.

In a preferred embodiment, during a time period in which a low impedance situation is believed to persist (e.g., after an initial high spark energy period of approximately 0.1 to 0.25 sec), the controller is programmed to open and close the switch 32 in rapid succession to generate a pulse group with a duration $T_1$ of about 350 microseconds, a pulse-group separation $T_2$ of 4 milliseconds, and a group repetition period of about 50 milliseconds, as generally depicted in FIGS. 3*a*, 5*a*, 5*b*. In a particular preferred embodiment, a first pulse group of five to fifteen pulses spans a period of 300 to 400 μsec. This is followed, after a pause of about 4 msec by a second group of five to fifteen pulses. The second group is followed by a somewhat longer delay of 50-100 msec to allow the capacitor to fully recharge, following which the first group/second group sequence is repeated.

As noted above, this selection of pulse duration and pause duration is made to accord with physiological information on muscle control. Pulse durations of 150-500 microseconds are optimal for activating the nerves that control skeletal muscles and for causing involuntary cramping. A pulse-group repetition rate of 4 milliseconds assures that the cramping voltage is re-applied just as the effects of the previous pulse are dissipating. A pulse train of this sort is referred to as a "Nerv-Lok" waveform.

In other embodiments of the stun device invention, to further enhance nerve and muscle incapacitation, a plurality (N) of pulse groups may be generated all with time interval spacings of approximately 4 milliseconds. In these embodiments, the capacitor 34 would typically be exhausted by 1/N of its total energy capacity by a string of N pulse groups. Once exhausted, the capacitor would be recharged fully once again by the power supply 30. In compact embodiments that seek to keep the total power requirements within the 10 watt to 20 watt range, it may be noted that the time interval for recharge would ordinarily take much longer than 4 milliseconds.

Many operating modes can be offered in an electrical incapacitating device of the invention that provides controllable discharge pulses. A preferred embodiment of a stun-gun 10 provides manual, semi-automatic and fully automatic modes of operation that differ from each other in the weapon's response to a trigger pull. For example, in a 'full manual' operation the stun-gun operates at the Max-Spark rate for 0.2 sec and then outputs the "Nerv-LoK" waveform for up to four seconds, and for less time if the trigger is released during operation. In a semi-automatic operating mode the Max-Spark waveform is delivered for 0.2 seconds, followed by 0.8 seconds of the Nerv-Lok waveform, following which the weapon continues to put out the Nerv-Lok waveform as long as the trigger is held back for up to a maximum total elapsed operational time of four seconds. In a full-automatic operation the stun gun provides 0.2 seconds of Max-Spark, followed by 3.8 seconds of Nerv-Lok.

Any one of the operational modes of a preferred stun-gun may be selected by having the gun's controller 28 communicate with another computer 50 running a special program that allows a user, usually a police department administrator, to select the desired operational mode, and store that mode selection in a non-volatile memory 52 that is associated with the controller 28 and that may also provide storage for trigger-usage history data.

Figure 6:
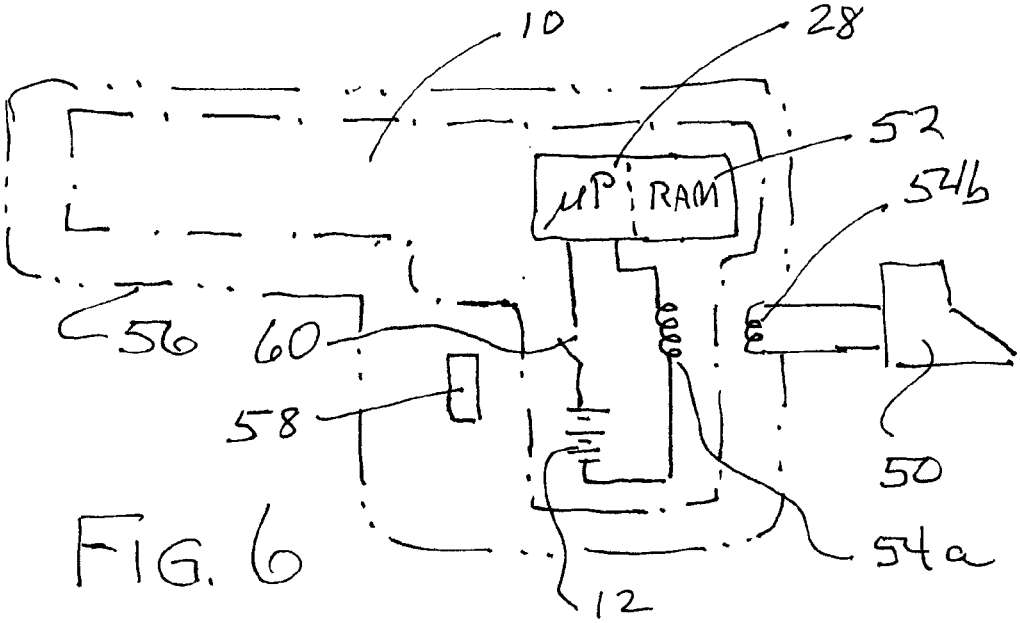
FIG. 6 is a schematic depiction view of a data dock arrangement for transferring data between a non-volatile memory in a stun gun and an external computer.

In a particular preferred embodiment the stun-gun controller 28 communicates with the external computer 50 by means of a wireless proximity coupling circuit. In this embodiment an inductor 54*a* in the gun 10 couples to another inductor 54*b* built into a docking station 56 connected to the external computer 50 when the wireless proximity coupling circuit is activated. The docking station, schematically depicted in double-dot phantom in FIG. 6, is preferably configured to conveniently receive the gun in a standard position in which a permanent magnet 58, built into the docking station, is close enough to a magnetic reed switch 60, disposed within the gun, so as to close the switch 60 and place the controller 28 into a communication mode in which data are transmitted between the controller and the external computer.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. An electric disabling device for immobilizing a human or animal target, the device comprising:

at least two electrodes positionable at spaced apart contact points adjacent the target;

a transformer having a primary winding and a secondary winding;

a capacitor electrically connected to the primary winding of the transformer;

a DC power supply operable to charge the capacitor; and a semiconductor switch directly electrically connected to the primary winding, and controllable by a control circuit to repeatedly switch between a conducting state and a non-conducting state so as to cause a plurality of pulses of current to flow from the capacitor through the primary winding of the transformer during an interval of at least ten microseconds but not more than one millisecond; and an output circuit comprising two legs connectable through the target, each leg respectively connected between one of the two ends of the secondary winding of the transformer and a respective one of the electrodes, each leg comprising a plurality of series-connected high voltage diodes, the two legs, when connected through the target, having a breakdown voltage in excess of a selected arc-over voltage.

2. The disabling device of claim 1 wherein the semiconductor switch comprises an insulated gate bipolar transistor.

3. The disabling device of claim 1 wherein the selected arc-over voltage is at least 55 kV.

4. An electric disabling device for immobilizing a human or animal target, the device comprising:

at least two electrodes positionable at spaced apart points adjacent the target;

a transformer having a primary winding and a secondary winding;

a capacitor electrically connected to the primary winding of the transformer;

a DC power supply operable to charge the capacitor; and an insulated gate bipolar transistor switch directly electrically connected to the primary winding, and controllable by a control circuit to repeatedly switch between a conducting and a non-conducting state so as to cause a plurality of pulses of current to flow from the capacitor through the primary winding of the transformer;

wherein the two ends of the secondary winding are electrically connectable through the target by a series string of high voltage diodes, the series string characterized by a breakdown voltage in excess of a selected arc-over voltage.

5. The disabling device of claim 4 wherein the selected arc-over voltage is 55 kV.

* * * * *

US007778005C1

(12) INTER PARTES REEXAMINATION CERTIFICATE (769th)

United States Patent

Saliga

(10) Number: US 7,778,005 C1

(45) Certificate Issued: Dec. 12, 2013

(54) ELECTRIC DISABLING DEVICE WITH CONTROLLED IMMOBILIZATION PULSE WIDTHS

(75) Inventor: Thomas V Saliga, Tampa, FL (US)

(73) Assignee: Debt Opportunity Fund, LLLP, Land O'Lakes, FL (US)

Reexamination Request:
No. 95/001,622, May 16, 2011

Reexamination Certificate for:

| | |
|---|---|
| Patent No.: | **7,778,005** |
| Issued: | **Aug. 17, 2010** |
| Appl. No.: | **11/746,952** |
| Filed: | **May 10, 2007** |

(51) Int. Cl.
*F41B 15/04* (2006.01)

(52) U.S. Cl.
USPC ..... 361/232; 361/230; 102/501; 102/502

(58) Field of Classification Search
None
See application file for complete search history.

(56) References Cited

To view the complete listing of prior art documents cited during the proceeding for Reexamination Control Number 95/001,622, please refer to the USPTO's public Patent Application Information Retrieval (PAIR) system under the Display References tab.

*Primary Examiner* — Linh M. Nguyen

(57) ABSTRACT

A capacitive discharge stun-gun uses a flyback output circuit in which a semiconductor switch operates under control of a controller or suitable logic circuitry. The flyback circuit can deliver 50-65 kV pulses to a pair of electrodes in order to ionize air adjacent a target in order to initiate good electrical contact. When the electrodes are in good contact with the target, the flyback circuit delivers current at a lower voltage. In one mode of operation the stun-gun is controlled to initially deliver wider pulses optimized for causing air breakdown and to then deliver a series of shorter pulses in pulse groups optimized for causing involuntary muscle cramping.

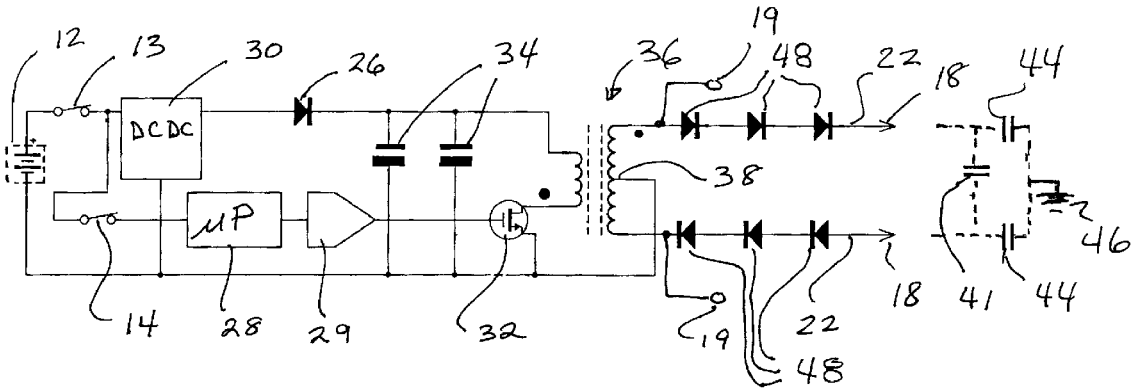

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 4 are determined to be patentable as amended.

Claims 2, 3 and 5, dependent on an amended claim, are determined to be patentable.

New claims 6 and 7 are added and determined to be patentable.

1. An electric disabling device for immobilizing a human or animal target, the device comprising:

at least two electrodes positionable at spaced apart contact points adjacent the target;

a transformer having a primary winding and a secondary winding;

a capacitor electrically connected to the primary winding of the transformer;

a DC power supply operable to charge the capacitor; and a semiconductor switch directly electrically connected to the primary winding, and controllable by a control circuit to repeatedly switch between a conducting state and a non-conducting state so as to cause a plurality of pulses of current to flow from the capacitor through the primary winding of the transformer during an interval *having a selected duration* of at least ten microseconds but not more than one millisecond; and an output circuit comprising two legs connectable through the target, each leg respectively connected between one of the two ends of the secondary winding of the transformer and a respective one of the electrodes, each leg comprising a plurality of series-connected high voltage diodes, the two legs, when connected through the target, having a breakdown voltage in excess of a selected arc-over voltage.

4. An electric disabling device for immobilizing a human or animal target, the device comprising:

at least two electrodes positionable at spaced apart points adjacent the target;

a transformer having a primary winding and a secondary winding;

a capacitor electrically connected to the primary winding of the transformer;

a DC power supply operable to charge the capacitor; and an insulated gate bipolar transistor switch directly electrically connected to the primary winding, and controllable by a control circuit to repeatedly switch between a conducting and a non-conducting state so as to cause a plurality of pulses of current to flow from the capacitor through the primary winding of the transformer *during an interval having a selected duration of at least ten microseconds but not more than one millisecond*;

wherein the two ends of the secondary winding are electrically connectable through the target by a series string of high voltage diodes, the series string characterized by a breakdown voltage in excess of a selected arc-over voltage.

*6. The electric disabling device of claim 1 wherein the semiconductor switch directly electrically connected to the primary winding is controllable by the control circuit to cause the plurality of pulses of current to flow from the capacitor through the primary winding of the transformer during a plurality of intervals, each interal having the selected duration of at least ten microseconds but not more than one millisecond, wherein each of the plurality of intervals is followed by a pause of approximately four milliseconds.*

*7. The electric disabling device of claim 4 wherein the insulated gate bipolar transistor switch is controllable by the control circuit to cause the plurality of pulses of current to flow from the capacitor through the primary winding of the transformer during a plurality of intervals, each having the selected duration of at least ten microseconds but not more than one millisecond, wherein each of the plurality of intervals is followed by a pause of approximately four milliseconds.*

* * * * *